US011078687B2

(12) United States Patent
Mack et al.

(10) Patent No.: US 11,078,687 B2
(45) Date of Patent: Aug. 3, 2021

(54) LOCKABLE FIREARM SAFE

(71) Applicant: Hornady Manufacturing Company, Grand Island, NE (US)

(72) Inventors: Matthew Mack, Grand Island, NE (US); Thomas Delattre, Stuart, FL (US)

(73) Assignee: Homady Manufacturing Company, Grand Island, NE (US)

( * ) Notice: Subject to any disclaimer, the term of this patent is extended or adjusted under 35 U.S.C. 154(b) by 445 days.

(21) Appl. No.: 15/978,283

(22) Filed: May 14, 2018

(65) Prior Publication Data

US 2018/0335275 A1 Nov. 22, 2018

Related U.S. Application Data

(60) Provisional application No. 62/508,164, filed on May 18, 2017.

(51) Int. Cl.

| | |
|---|---|
| ***E05B 65/00*** | (2006.01) |
| ***F41C 33/06*** | (2006.01) |
| ***E05B 35/00*** | (2006.01) |
| ***E05G 1/00*** | (2006.01) |
| ***E05B 57/00*** | (2006.01) |
| ***E05B 47/00*** | (2006.01) |

(Continued)

(52) U.S. Cl.

CPC ..... *E05B 65/0075* (2013.01); *E05B 35/00* (2013.01); *E05B 47/0001* (2013.01); *E05B 57/00* (2013.01); *E05B 65/5284* (2013.01); *E05C 3/24* (2013.01); *E05G 1/005* (2013.01); *F41C 33/06* (2013.01); *E05B 2047/0094* (2013.01)

(58) Field of Classification Search

CPC ..... E05B 35/00; E05B 47/00; E05B 47/0001; E05B 47/02; E05B 47/023; E05B 47/0607; E05B 2047/0067; E05B 2047/0072; E05B 49/00; E05B 51/00; E05B 65/006; E05B 65/0075; E05B 65/52; E05B 65/5207; E05B 65/5246; E05B 65/5253; E05B 65/5261; E05B 65/5284; E05B 85/26; E05G 1/00; E05G 1/005; E05G 1/026; E05G 1/04; F41C 33/06; E05C 3/006; E05C 3/12; E05C 3/16; E05C 3/165; E05C 3/167; E05C 3/22; E05C 3/24; E05C 3/26; E05C 3/28; E05C 3/30; E05C 3/34; E05C 9/08; E05C 9/085

See application file for complete search history.

(56) References Cited

U.S. PATENT DOCUMENTS

| | | | | |
|---|---|---|---|---|
| 2,217,098 A * | 10/1940 | Brownne | ..... | E05C 3/24 292/198 |
| 3,017,678 A | 1/1962 | Christensen | | |
| 3,435,642 A | 4/1969 | Pesco | | |

(Continued)

FOREIGN PATENT DOCUMENTS

| | | |
|---|---|---|
| CA | 2047252 | 8/1993 |
| EP | 1092615 | 4/2001 |

(Continued)

*Primary Examiner* — Christopher J Boswell

(74) *Attorney, Agent, or Firm* — McHale & Slavin, P.A.

(57) ABSTRACT

A gun safe adapted for securing a firearm. The safe includes a storage chamber formed by a lid and a base. The safe includes a latch mechanism that can be locked and unlocked electronically. The safe can also be provided with a manual lock override.

20 Claims, 13 Drawing Sheets

(51) Int. Cl.
*E05C 3/24* (2006.01)
*E05B 65/52* (2006.01)

(56) References Cited

U.S. PATENT DOCUMENTS 3,885,166 A 2/1975 Pedro
3,890,813 A * 6/1975 Cothron ..... E05B 47/0607 70/92
4,086,795 A 5/1978 Foster et al.
4,155,608 A 5/1979 Orlewicz
D267,470 S 1/1983 Scherbing
4,404,822 A 9/1983 Green
4,489,833 A 12/1984 Bauer
4,543,806 A 10/1985 Papandrea et al.
4,970,882 A 11/1990 Arrendondo
5,172,575 A * 12/1992 Fisher ..... E05B 37/20 206/317
D347,157 S 5/1994 Brown
5,361,612 A 11/1994 Voiculescu et al.
5,408,212 A 4/1995 Meyers et al.
D370,401 S 6/1996 Minkin
5,531,083 A 7/1996 Franck, III et al.
5,549,337 A * 8/1996 McCulloch ..... E05B 47/0012 292/201
5,603,416 A 2/1997 Richardson
5,713,149 A 2/1998 Cady et al.
5,768,920 A 6/1998 DeBevoise
5,881,584 A * 3/1999 Brunoski ..... E05B 17/2084 292/144
6,003,348 A 12/1999 McCrea
D427,883 S 7/2000 Ling
6,089,054 A 7/2000 Stukas et al.
6,167,734 B1 1/2001 Derman
6,192,719 B1 2/2001 Stukas et al.
6,223,461 B1 5/2001 Mardirossian
6,237,271 B1 5/2001 Kaminski
6,260,300 B1 7/2001 Klebes et al.
6,279,359 B1 * 8/2001 Boisvert ..... E05B 65/52 109/51
6,351,906 B1 3/2002 Honig, Jr. et al.
6,408,555 B1 6/2002 Sapia et al.
6,505,846 B1 1/2003 Hoffman
6,523,372 B1 2/2003 McDaid et al.
6,570,501 B2 * 5/2003 Bushnell ..... E05B 47/0002 206/1.5
6,581,421 B2 6/2003 Chimela et al.
6,595,031 B2 7/2003 Wilson et al.
6,681,603 B1 1/2004 Yu et al.
6,845,640 B2 1/2005 Loeff et al.
6,918,519 B2 7/2005 Von Keller et al.
7,025,202 B2 4/2006 Jansen et al.
7,104,093 B2 9/2006 Ling
7,200,965 B2 4/2007 Von Keller et al.
7,299,668 B1 11/2007 Lu
7,302,816 B1 12/2007 Lu
7,318,563 B2 1/2008 Houts
7,448,156 B2 11/2008 Tucich
7,546,920 B1 * 6/2009 Horn ..... F41C 33/06 70/63
7,562,480 B2 7/2009 Mauch et al.
D617,525 S 6/2010 Taylor et al.
7,861,562 B2 1/2011 Tollefson
7,870,764 B2 1/2011 Burmesch
7,903,846 B2 3/2011 Fisher
8,020,903 B2 * 9/2011 Graute ..... E05B 81/66 292/216
8,196,945 B2 6/2012 Hensley
8,207,816 B2 6/2012 Crigger et al.
8,228,192 B2 7/2012 Eckert et al.
8,342,324 B2 1/2013 Debias
8,418,391 B2 4/2013 Kemmerer et al.
8,485,613 B1 7/2013 Steffen et al.
8,499,804 B2 8/2013 Schulte
8,713,836 B1 5/2014 Haq
8,720,097 B2 5/2014 Derman
8,950,596 B2 2/2015 Arabian et al.
8,966,947 B2 * 3/2015 Karcz ..... E05B 65/0007 70/135
9,007,170 B2 4/2015 Wall et al.
9,013,301 B2 4/2015 Williams
D738,703 S 9/2015 Thomson
9,266,697 B2 2/2016 Houston et al.
9,293,019 B2 3/2016 Perreau et al.
9,303,950 B2 4/2016 Fuller
9,328,536 B2 5/2016 Shulte et al.
9,423,211 B2 * 8/2016 Ho ..... E05B 37/163
9,488,427 B1 11/2016 Lucero
9,530,266 B2 * 12/2016 Delattre ..... E05G 1/005
9,534,867 B2 1/2017 Dunn et al.
9,719,286 B2 8/2017 Wall et al.
9,740,920 B1 8/2017 Chang et al.
10,253,529 B1 * 4/2019 McGinn ..... E05B 35/00
2002/0158095 A1 10/2002 Vor Keller et al.
2002/0174587 A1 11/2002 Rumfelt
2004/0083778 A1 5/2004 Loeff et al.
2004/0237606 A1 12/2004 Iwamoto
2005/0194872 A1 9/2005 Cleveland et al.
2008/0134556 A1 6/2008 Remelin
2008/0203860 A1 8/2008 Myers
2009/0223104 A1 9/2009 Anzeloni
2010/0270201 A1 10/2010 Cauley et al.
2012/0085134 A1 4/2012 Ezzo et al.
2012/0210755 A1 8/2012 Shafer
2012/0291327 A1 11/2012 Boutot et al.
2013/0312306 A1 11/2013 Ruffin
2014/0110363 A1 4/2014 Brown et al.
2014/0145819 A1 5/2014 Wall et al.
2014/0215881 A1 8/2014 Milde et al.
2014/0263107 A1 9/2014 Arabian et al.
2015/0168100 A1 6/2015 Hyde et al.
2015/0198402 A1 7/2015 Brace
2015/0260480 A1 9/2015 Dunn et al.
2015/0337588 A1 11/2015 Kanhai
2016/0053526 A1 2/2016 Dittrich
2016/0054080 A1 2/2016 Haimi
2017/0138112 A1 5/2017 Makke et al.

FOREIGN PATENT DOCUMENTS

WO WO8300354 2/1983
WO WO9107560 5/1991

* cited by examiner

LOCKABLE FIREARM SAFE

RELATED APPLICATIONS

In accordance with 37 C.F.R 1.76, a claim of priority is included in an Application Data Sheet filed concurrently herewith. Accordingly, the present invention claims priority to U.S. Provisional Patent Application No. 62/508,164, filed May 18, 2017, entitled, "LOCKABLE FIREARM SAFE", the contents of the above referenced application is herein incorporated by reference in its entirety.

FIELD OF THE INVENTION

A lockable safe for securing a firearm, such as a pistol or long gun, from both unauthorized access and movement from a location.

BACKGROUND OF THE INVENTION

Gun ownership has been increasing in recent years. The concern for safe storage of guns has also increased. Safe gun storage has two components: the first is unauthorized use from easy access, and the second is theft. While no means has been provided which absolutely provides security for both, the goal is to make access and theft more difficult and timely to achieve.

Numerous devices have been provided to achieve one or both goals. For example, there are numerous types of trigger locks available that make unauthorized use much more difficult by precluding easy access to the trigger of the firearm. These have been provided for both long guns, for example rifles and shotguns, and for handguns, such as pistols. While effective, they have no impact on theft or unauthorized movement to a different location. Because of the different shapes of trigger guards, some trigger locks can be difficult to use on one firearm, while easy to use on another firearm.

Storage containers have also been provided for securing firearms. One form of a storage container is the so-called gun safe. High quality gun safes are large and very heavy, and take up a lot of space. Some can weigh on the order of 2,000 pounds, and will withstand high temperature from a fire for a limited time. They are not easily movable and require a significant amount of time to open. They can be provided with either a mechanical combination lock or an electronic combination lock. While likely the most secure, they have the aforementioned drawbacks. Another form of storage container is a portable locking box. Numerous versions are available on the market. They provide a fair level of resistance to unauthorized access to a firearm contained inside, but are small and therefore readily portable, making theft easy. Typically, such boxes are used for the storage of pistols. Such portable boxes can be easily stored at any desired location, for example in a drawer next to a bed, making them readily available for use in a time of need.

A typical portable locking safe has a lid portion hinged to a storage base. Upon unlocking, the lid is moved to an open position, providing access to the contained firearm. However, many of these boxes can have a tool easily inserted between the lid and the base to pry the lid open. Typically, such boxes can be readily moved about a premise, or removed from the premises easily.

The portable locking safes are not readily amenable to securing long guns because of the length of such guns, typically more than 40 inches, although some AR style rifles are a little shorter.

Thus, there is a need for an improved lockable firearm safe.

DESCRIPTION OF THE PRIOR ART

One form of firearm storage is the so-called gun safe. It provides a high degree of security from both unauthorized access and theft. Typically, such a gun safe is also made "fire proof" or, more accurately, heat resistant for a period of time. However, they are heavy and, once in place, difficult to move within a premises. They also have limited areas in a house or other building in which they can be placed because of their size and weight.

Another form of firearm storage is a lockbox. These tend to be small and relatively portable, allowing their positioning at any desired place within a premise. While providing resistance to unauthorized access, their ready portability provides little, if any, resistance to theft. They also tend to be built in a manner that allows forced easy opening of the box without a key or combination. They also typically require some human operation once the lid is closed to lock it in the closed position.

SUMMARY OF THE INVENTION

A primary objective of the present invention is to provide a firearm storage safe that is resistant to both unauthorized access to the firearm inside and its movement away from a desired location.

It is a further objective of the invention to provide an improved locking mechanism that can be unlocked both electronically and manually, and that locks automatically upon closure of the lid.

It is a further objective of the invention to provide a firearm storage safe that is difficult to open in an unauthorized manner.

It is yet another objective of the invention to provide a firearm storage safe that can be secured in a desired location.

It is a still further objective of the invention to provide a firearm storage safe that provides means to prevent damage to the firearm during storage.

Other objects and advantages of this invention will become apparent from the following description taken in conjunction with any accompanying drawings wherein are set forth, by way of illustration and example, certain embodiments of this invention. Any drawings contained herein constitute a part of this specification, and include exemplary embodiments of the present invention and illustrate various objects and features thereof.

DETAILED DESCRIPTION OF THE INVENTION

Figure 1:
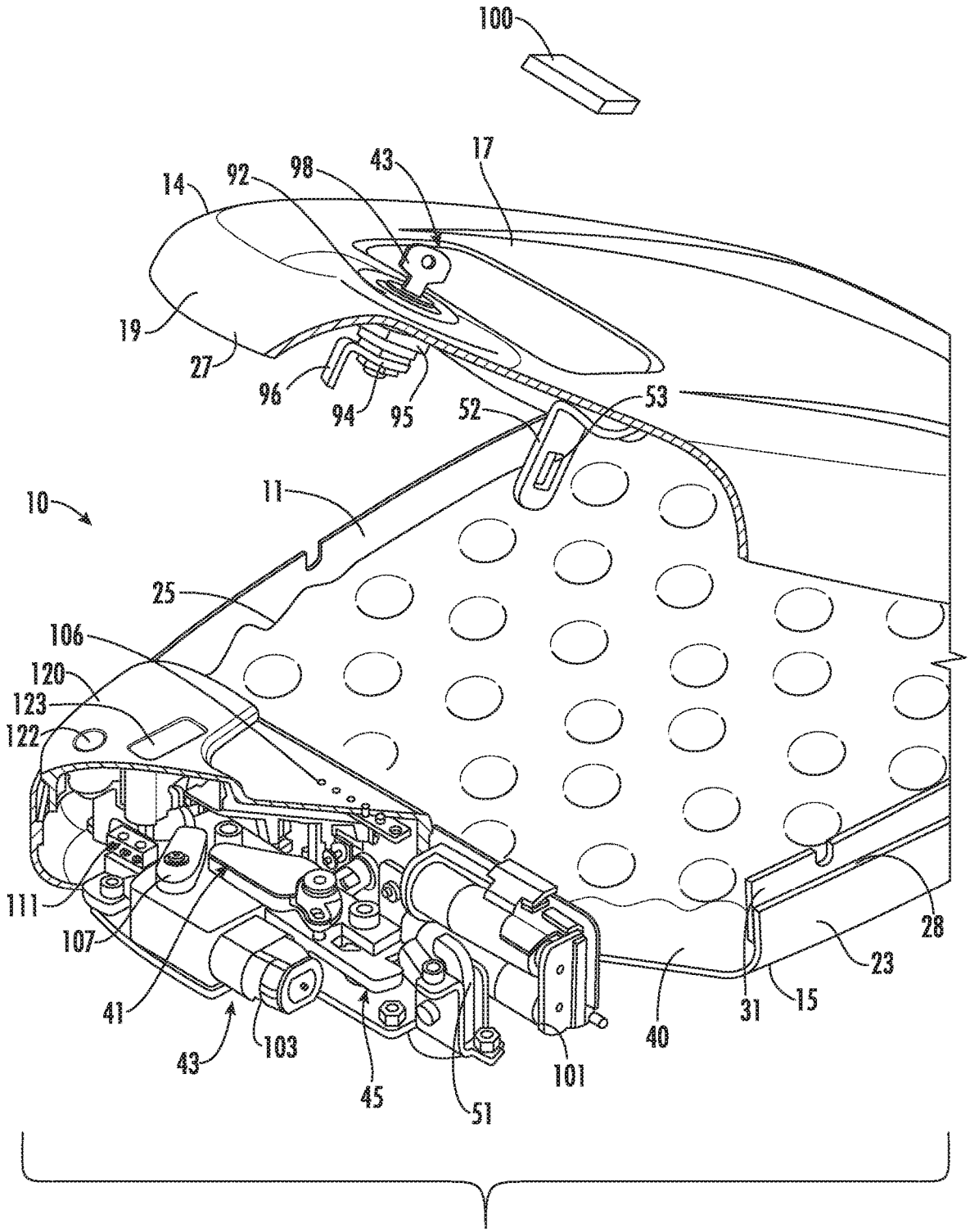
FIG. 1 is a fragmentary perspective view of a firearm storage safe.
Figure 2:
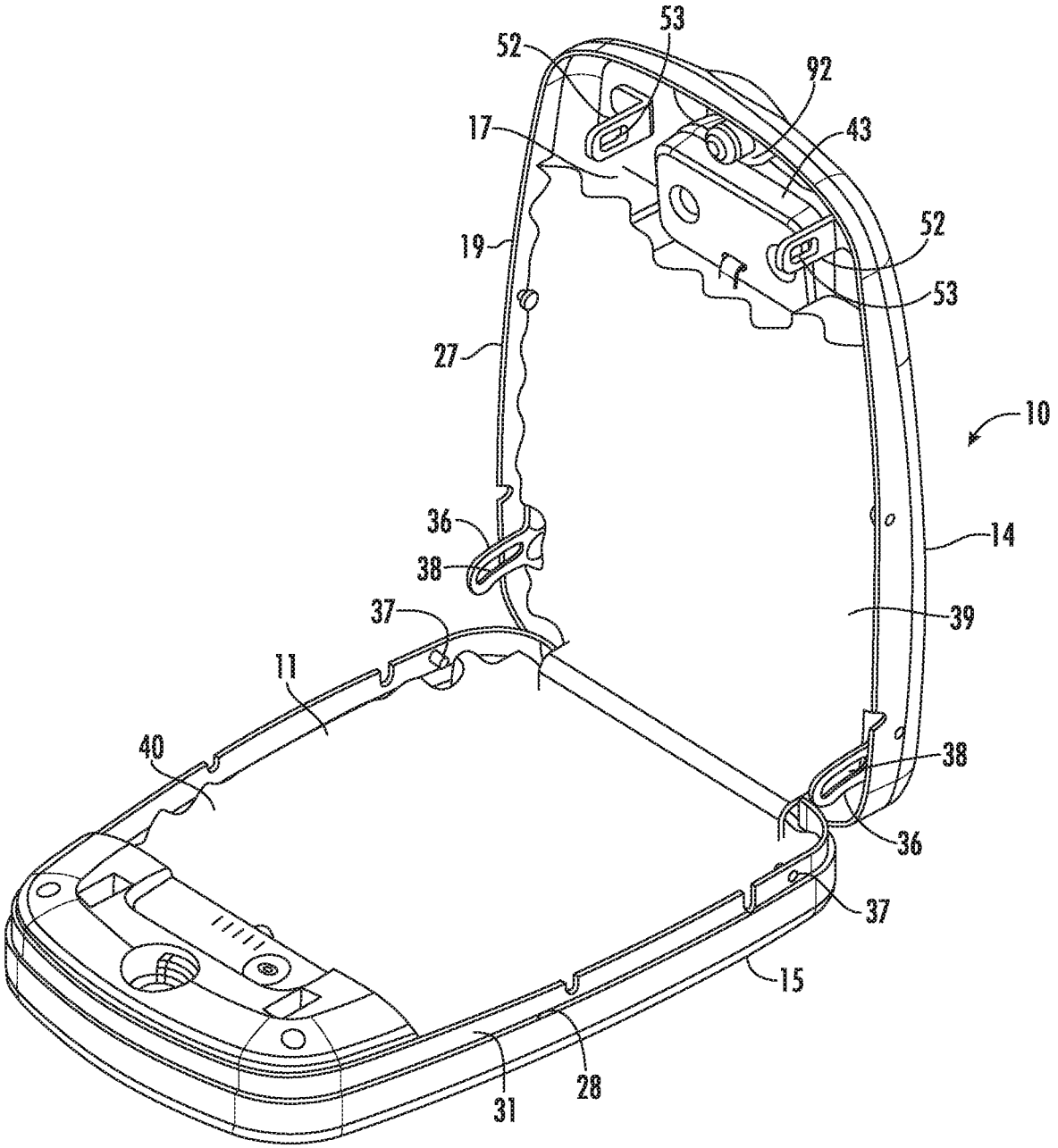
FIG. 2 is a perspective view of a firearm storage safe showing the lid in an open position with portions broken away to show internal detail.
Figure 3:
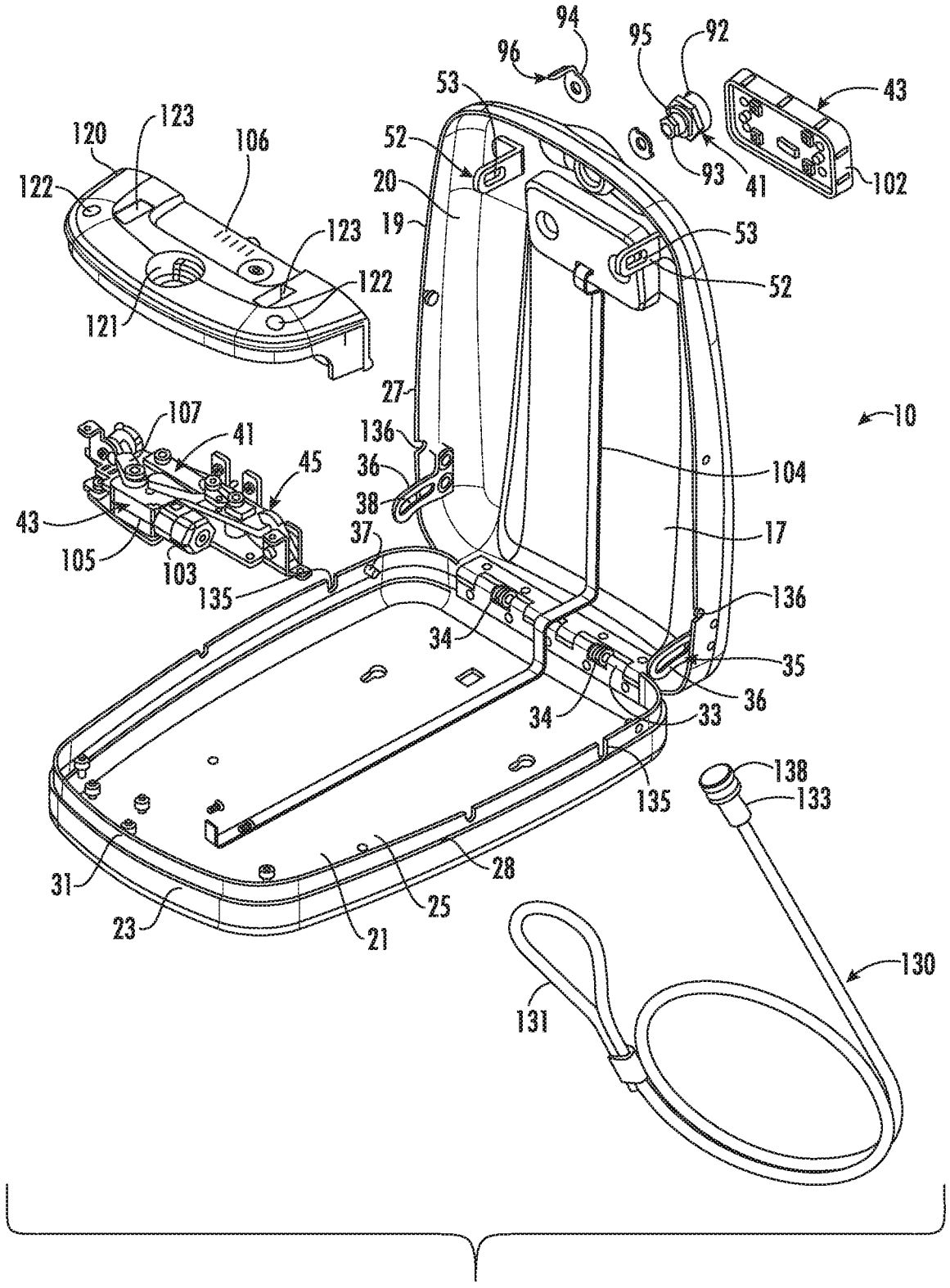
FIG. 3 is an exploded perspective view of the storage safe.

FIGS. 1-3 illustrate a first embodiment of a firearm storage safe. The present invention provides a storage device usable for storing a firearm or other valuable internally in a storage chamber 11. The device is a housing having a pair of hingedly connected components that, when in a closed configuration, form the storage chamber 11. In the illustrated structure, the reference numeral 10 designates the storage device that is in the form of a storage safe usable for storing an object such as a firearm or other valuable, such as a pistol, internally in a storage chamber 11. For convenience, the stored item will be referred to hereinafter as a firearm, but is not limited to being a firearm. As shown, the safe 10 includes both a lid portion 14 and a base portion 15. While the safe 10 can be inverted, putting the base 15 on top and the lid 14 on the bottom, the differentiation is that the means for unlocking the safe 10 would be on the lid. In the illustrated structure, the lid 14 and base 15 are cup shaped. The lid 14 has a main panel 17 with an upstanding sidewall 19 extending around the perimeter of the panel 17, forming a chamber portion 20 with an open side. The base 15 is similar in construction to the lid 14, having a main panel 21 with an upstanding sidewall 23 extending around the perimeter of the panel 21, forming a chamber portion 25 with an open side. A plurality of keyhole slots (not shown) can be provided in the panel 21 for facilitating mounting of the safe 10 to a wall or other structural member. The size and shape of the sidewalls 19 and 23 are similar so that their exposed edges 27, 28 mate when the lid 14 is in the closed position. In the illustrated embodiment, the base 15 is provided with an upstanding flange 31 that is positioned internally of the sidewall 23, and is received inside of, or sleeved, into the sidewall 19 when the lid 14 is in a closed position. Preferably, the flange 31 is integral with the sidewall 23, but can be formed separately and secured to the sidewall, as by welding. The edge 28 forms a ledge between the sidewall 23 and flange 31, and is preferably rounded or beveled on the outside to resist a prying tool from applying a force between edge 28 and edge 27. The lid 14 and base 15 are joined together at adjacent edges of their respective sidewalls 19, 23, as with a hinge 33 that permits permanent joining of the lid and base together, and allows relative movement therebetween. The hinge 33 can be provided with one or more springs 34 (FIG. 3), such as torsion springs, to effect selective unassisted opening movement of the lid 14. In a preferred embodiment, the lid 14 and base 15 are formed of a metallic material such as steel, and can have a protective coating such as paint or the like thereon. Stops 35 are provided to limit opening movement of the lid 14 relative to the base 15. As shown, there is a stop 35 on each side of the safe 10. Any suitable stop can be used. As shown, a stop 35 includes a slotted arm 36 secured to the lid 14 and a pin 37 secured to the base 15 and extending into a slot 38. One or more gas springs could also be used, eliminating the need for the springs 34.

Cushions 39, 40 are provided in the chamber portions 20, 25, respectively, to protect a firearm when stored inside the safe 10. Suitable cushioning material can be open cell foam, as is known in the art. Preferably, the cushions 39, 40 can be adhered in place with a suitable adhesive.

The safe 10 is provided with a locking mechanism that includes a plurality of components, FIGS. 3-7. It includes a manual lock mechanism designated generally 41, an electronic lock actuator designated generally 43, and a latch mechanism designated generally 45. The mechanisms 41, 43, 45 cooperate with one another to effect locking the lid 14 in a closed configuration, and unlocking the lid 14 to allow it to move to an open position.

Figure 5:
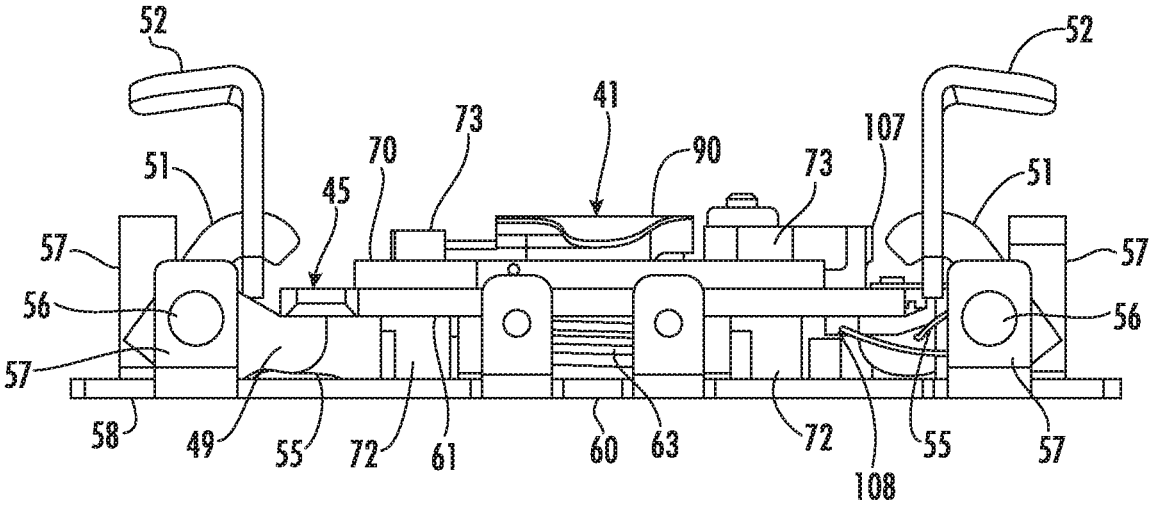
FIG. 5 is a side elevation view of the latch mechanism shown in a locked configuration.
Figure 6:
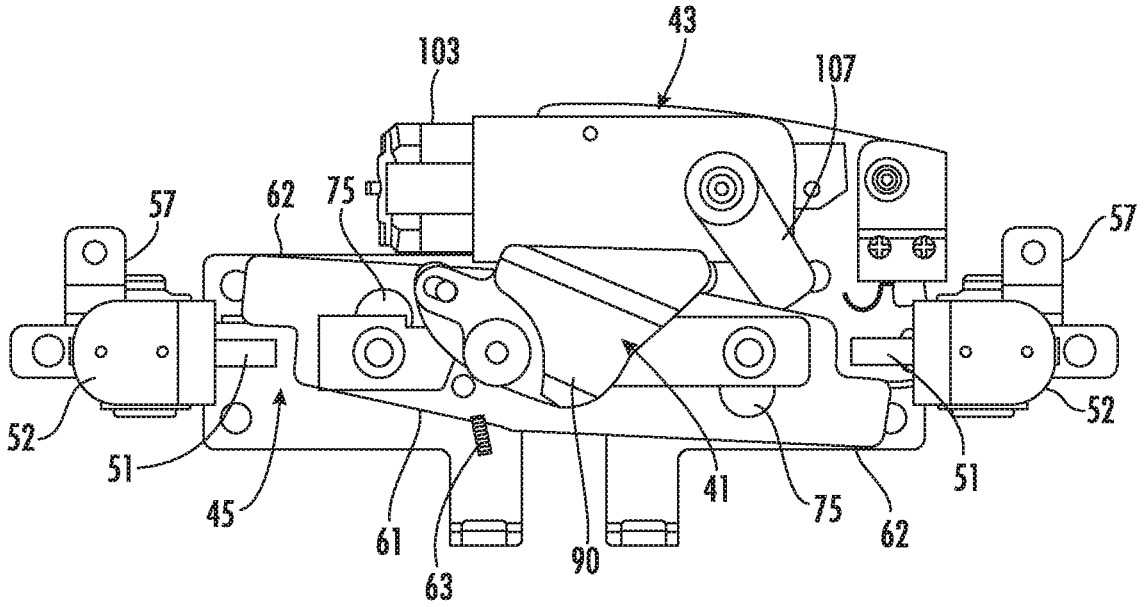
FIG. 6 is a top plan view of the latch mechanism shown in an unlocked configuration.
Figure 7:
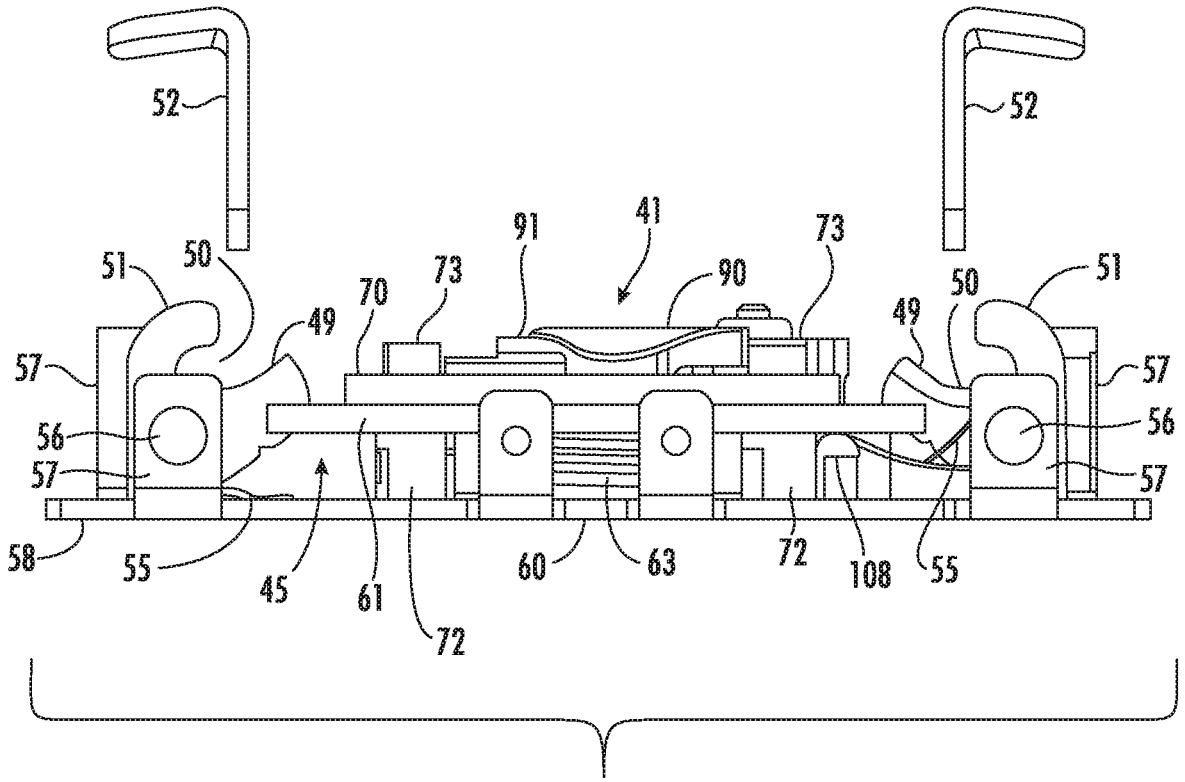
FIG. 7 is a side elevation view of the latch mechanism shown in an unlocked configuration.

The latch mechanism 45 is seen in FIGS. 3-7, and is secured to the base 15. While portions of the latch mechanism are shown as being attached to the base 15 and the catch members 52 are shown and described as being attached to the lid 14, it is to be understood that this arrangement could be reversed. The latch mechanism 45 is illustrated as having a latching portion separate from the catch members 52 and having at least one latch member 51, and preferably a pair of spaced apart latch members 51, each positioned adjacent a respective side of the base 15. The latch members 51 are pivotally mounted hooks that have throats 50 opening inwardly and a foot 49 extending inwardly to selectively extend under a pawl member described below. The latch mechanism 45 also includes at least one catch member 52, and preferably a pair of catch members 52. The catch members 52 are each positioned adjacent a respective side of the base 15. When the lid 14 is locked in the closed configuration, each latch member 51 is engaged with a respective catch member 52 secured to the lid 14 by extending through a slot 53. The latch members 51 are each biased to a release position, pivoted outwardly, as with a respective torsion spring 55 mounted on a respective latch pivot pin 56. The movement of the latches 51 for opening, i.e., outwardly, is in opposite directions of the movement for latching, i.e., inwardly. The release position is an outward pivoted position as seen in FIG. 7. The pivot pins 56 are mounted to a respective pair of spaced apart arms 57 integral with and extending from a base 58. The latch base 58 is secured to the panel 21 of the base 15 in any suitable manner, as by welding or mechanical fasteners.

Figure 4:
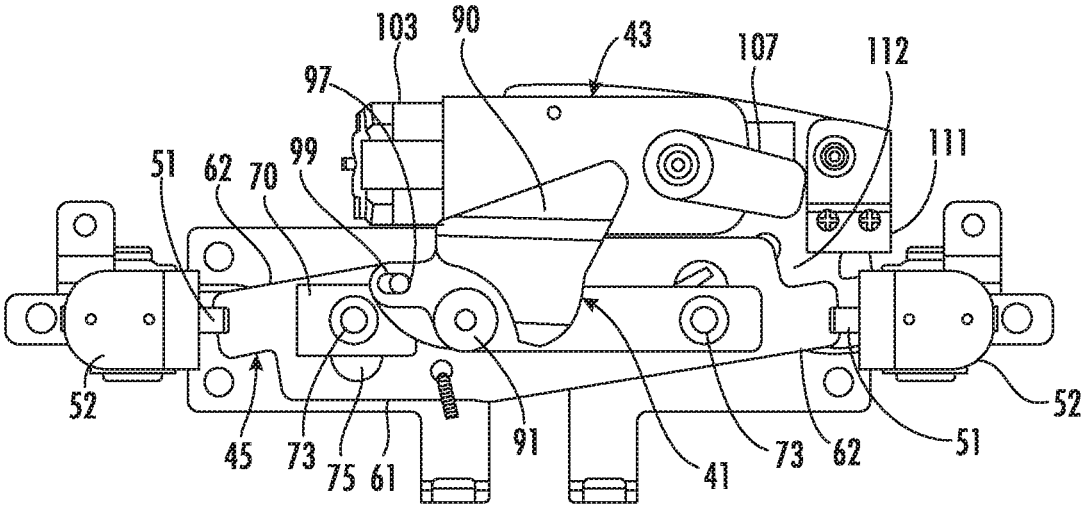
FIG. 4 is a top plan view of a latch mechanism shown in a locked configuration.

As seen in FIGS. 4, 5, a pawl member 61, e.g. in the form of a flat plate, is pivotally mounted to the latch base 58 with a pivot pin 60. The pawl 61 includes a pair of arms 62, each associated with a respective latch member 51 for releasably retaining the latch members 51 in a latching position, as seen in FIG. 4. As shown, the pawl 61 is balanced such that it pivots on the pivot pin 60 at its approximate center of mass. If the safe 10 is dropped, this centering and friction applied to the pawl will prevent a sufficient torque being applied from imbalance to force the pawl to pivot to a position wherein the latch members 51 are released and can move to an open position. A resilient biasing member, such as a torsion spring 63, is mounted on the pin 60 and resiliently biases the pawl 61 to its latching position as seen in FIGS. 4, 5. The foot 49 of a latch 51 engages a side of a respective arm 62 under biasing force influence of the spring 63 to releasably retain the pawl in its unlatched position, as seen in FIGS. 6, 7. The feet 49 are also positioned under and engage a respective arm 62 to releasably hold the latches 51 in their lid closed retaining position.

A hold down retainer 70 is mounted to the base 58 and overlies the pawl 61 to force it to pivot in a plane and not rock on the pivot pin 60 transverse to its pivot plane, and thus ensure it does not interfere with the pawl 61 moving to its latching position, as seen in FIG. 5. As shown, the retainer 70 is mounted on a pair of posts 72 secured to the base 58 and held in place by mechanical fasteners 73, such as threaded screws. The pawl 61 is provided with a pair of slots 75, each receiving a respective post 72 therethrough. The slots 75, in cooperation of the posts 72, limit pivoting movement of the pawl 61. The pawl 61 thus moves in a plane in a limited reciprocating manner. This plane of movement is generally parallel (within about +/−20°) to the panels 17, 21 when the lid 14 is closed, and generally normal to the plane of pivoting movement of the latches 51; that is, close enough to normal that the latches 51 will allow the arms 62 of the pawl 61 to move into and out of the throats 50 without functional interference.

The latch mechanism 45 cooperates with a plurality of operation actuators. One is an electronic actuator 43, and one is a mechanical actuator 41. The mechanical actuator 41 includes a lever 90 pivotally mounted on the retainer 70 on a pivot 91. It is noted that the retainer 70 does not move relative to the base 58. A mechanical lock 92, preferably a key lock of a tubular or barrel style, is mounted to the lid 14 and is keyed thereto to prevent rotation relative to the lid 14. It has a lock cylinder 95 with an output shaft 93 that can be rotated by operation of a key 98 (FIG. 1). A lock output arm 94 is fixed to the shaft 93 and rotatable therewith. When the lid 14 is closed, the arm 94 has a finger 96 that will engage an edge of the lever 90 to selectively effect its rotation. The lever 90 is coupled to the pawl 61 as with a post 99 secured to the pawl 61 and extending into a slot 97 through the lever 90, whereby pivoting movement of the lever 90 in response to actuation of the lock arm 94 will pivot the pawl 61 out of latching engagement with the latches 51, allowing the springs 55 to move the latches out of retaining engagement with the catches 52, allowing the lid 14 to open. This opening mode can be used as an override to the electronic actuator 43. Closing of the lid 14 will move the free ends of the catches 52 into engagement with the foot 49 of their respective latch 51 at a position beyond the end of its respective arm 62 to effect their pivoting against torque from the springs 55, and allow the arms 62 to move back over the feet 49 of the latches 51 automatically, under the influence of the spring 63, locking the lid in its closed position. The finger 96 has been returned to its normal position by rotation of the key 98 in a locking direction to effect its removal from the lock 92.

The electronic lock actuator 43 is preferably initiated using an RFID interrogator in opening operation wirelessly, as with a radio frequency or RFID tag 100. An RFID tag 100 can be on a wrist band, in a key fob, or in a decal form attached to a device such as a cell phone. In addition to a wireless signal operation, the actuator 43 can be provided with a touch pad (not shown) to enter a code that, if correct, will also effect opening of the lid 14 as described herein. The actuator 43 can be configured to accept a plurality of input codes or accommodate a plurality of different RFID tags or radio frequency transmitters. Biometric sensors could also be used to identify an approved user to effect unlocking and opening. The actuator 43 includes a source of electricity, such as a battery power supply 101 operably associated with an electronic control module 102. A battery condition indicator 106 can also be provided. The module 102 and battery 101 are operably coupled to one another and to an electric motor 103 via a communication cable 104. A plug in AC power supply, such as a transformer, can also be provided to reduce battery usage and allow the actuator 43 to be in a continuous power on mode. Further, the actuator 43 can be configured to turn off manually or automatically to conserve batteries. The actuator 43 can provide an indicator, preferably visual, such as an LED light, to indicate if the actuator is powered on with either AC or battery. Such an indicator can also show if the actuator needs to be turned on, if in battery saving mode, and provide a touch sensing switch means to effect powering the actuator 43 for opening the safe 10. The motor 103 can include a right angle drive output device, or drive, 105. The drive 105 includes an actuator arm 107 that is driven by the motor 103. The arm 107 includes a finger 108 that is operable to effect pivoting movement of the pawl 61 to its unlatched position, and release the lid 14 to open. Closing of the lid is effected as described above. Means is provided to positively stop the motor 103 and effect reverse rotation of the motor 103 and the arm 107 when the latches 51 are released. As shown, a switch 111 is mounted to the base 58 and has an actuator 112 that is positioned to engage the pawl 61 when the pawl has moved to its unlatched position. When engaged, the switch 111 provides a signal to the module 102 and effects power feed to the motor 103 to effect its reverse rotation, which moves the arm 107 and finger 108 back to their normal position for locking the lid 14 and allowing the pawl 61 and latches 51 to return to their latching positions. When the pawl 61 is in its latched position, the switch 111 is back in its normal operating condition. The latch mechanism 45 is now configured for closing and locking the lid 14.

A cover 120 is provided to shield the latch mechanism 45, power supply 101, motor 103, and drive 105 from contact with a contained firearm. The battery condition indicator 106 can be mounted on the cover 120. The cover 120 is mounted to the base 15 in a removable manner, as with one or more mechanical fasteners 122, to provide access to the batteries in the power supply 101 to effect their replacement. The cover 120 is provided with a through port 121 to allow the finger 96 access to the lever 90 to effect mechanical unlocking as described above. The cover 120 is also provided with through apertures 123 which are positioned to allow the catches 52 to move into selective engagement with their respective latch 51 for locking of the lid 14 in its closed position.

A second means of securing the safe 10 is provided. As shown, a tether 130 is provided, FIG. 3. The tether 130 is in the form of a cable having a loop 131 at least at one end thereof. The loop 131 is large enough to receive an opposite end of the tether 130 therethrough for securing the tether to a device, such as a bed frame or the like. The loop 131 can also be associated with a securement device, such as a padlock. The tether 130 is provided with means to secure it to the safe 10. In a preferred embodiment, the tether 130 is provided with a shoulder member 133 adjacent one end thereof, or movable to one end thereof. The shoulder member 133 is configured to have a portion fit inside the safe 10 to prevent withdrawal of the tether 130 from a closed safe 10. In one embodiment, the base 15 is provided with an open ended slot 135 in the flange 31, and the sidewall 19 of the lid 14 is also provided with an open ended slot 136 that aligns with a respective slot 135. The slots 135, 136 are sized and shaped to receive a shoulder forming portion 138 of the tether 130 inside the sidewalls 19, 23 and, when the lid 14 is closed, the shoulder member 133 is retained within the slots 135, 136 and the shoulder forming portion 138 resists the tether from separating from the safe 10.

Figure 8:
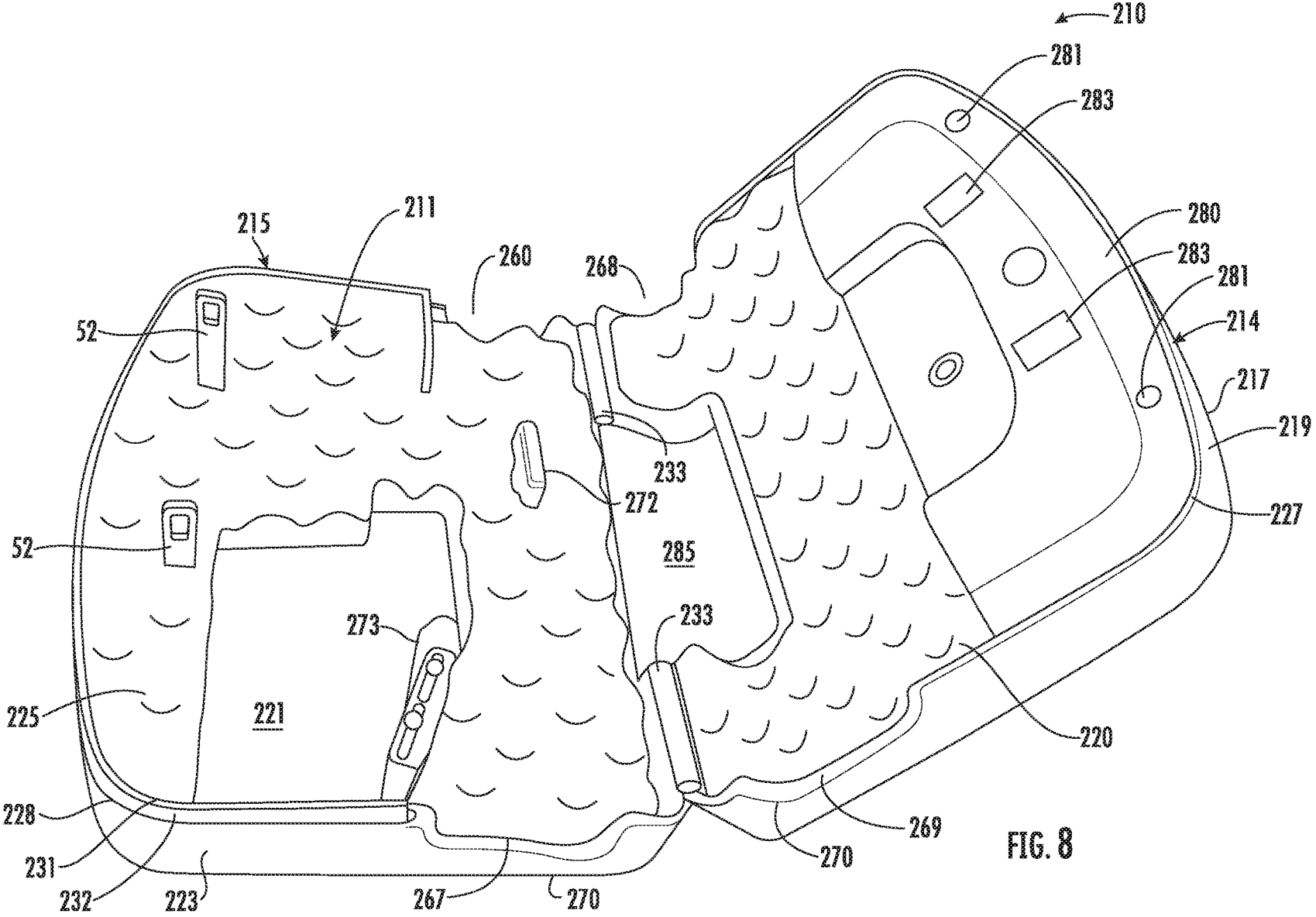
FIG. 8 is a perspective view of an alternate embodiment of a firearm storage safe for a rifle.
Figure 9:
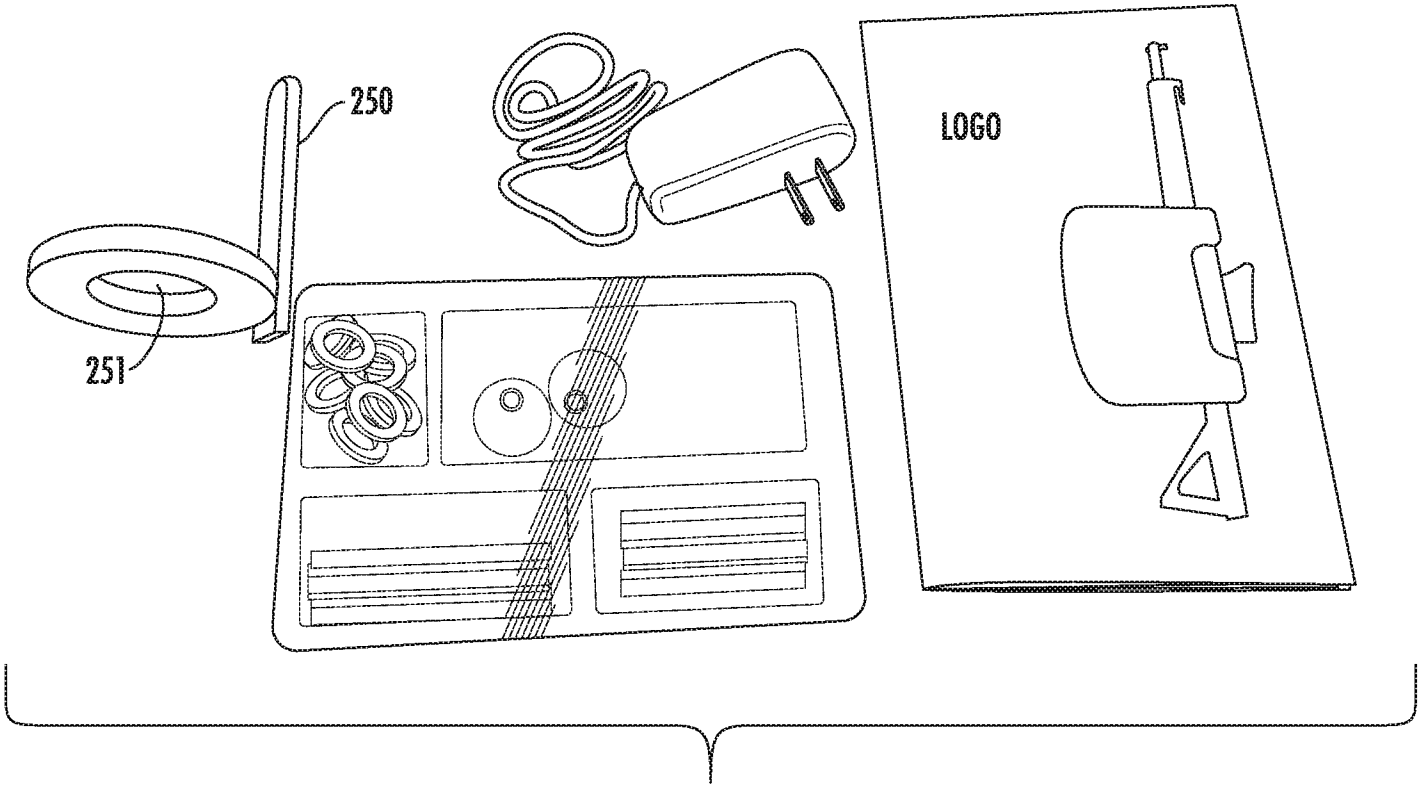
FIG. 9 is a perspective view of a barrel retaining bracket for use with the safe of FIG. 8.

FIGS. 8, 9 illustrate another embodiment of the present invention. It utilizes the same latch mechanisms 41, 43, 45 as disclosed above, but has a differently configured safe 210. The safe 210 is usable for storing a firearm, such as an AR style rifle, internally in a storage chamber 211. The safe 210 includes both a lid portion 214 and a base portion 215. In the illustrated structure, the lid 214 and base 215 are cup shaped. The lid 214 has a main panel 217 with an upstanding sidewall 219 extending around much of the perimeter of the panel 217, forming a chamber portion 220 with an open side. The base 215 is similar in construction to the lid 214, having a main panel 221 with an upstanding sidewall 223 extending around much of the perimeter of the panel 221, forming a chamber portion 225 with an open side. The size and shape of the sidewalls 219 and 223 are similar so that their exposed edges 227, 228 mate when the lid 214 is in the closed position. In the illustrated embodiment, the base 215 is provided with an upstanding flange 231 that is positioned internally of the sidewall 223, and is received inside of, or sleeved, into the sidewall 219 when the lid 214 is in a closed position. Preferably, the flange 231 is integral with the sidewall 223, but can be formed separately and secured to the sidewall, as by welding. The edge 228 forms a ledge 232 between the sidewall 223 and flange 231, and is preferably rounded or beveled on the outside to resist a prying tool from applying a force between edge 228 and edge 227. The lid 214 and base 215 are joined together at adjacent edges of their respective sidewalls 219, 223 as with a pair of hinges 233 that permit permanent joining of the lid 214 and base 215 together, and allow relative movement therebetween. In a preferred embodiment, the lid 214 and base 215 are formed of a metallic material such as steel, and can have a protective coating such as paint or the like thereon. The safe 210 is adapted for securing an AR style long gun. It differs from the safe 10 in size and shape, and allows portions of a contained gun to extend from opposite sides of the safe 210. Otherwise, and as described below, the construction of the safe 210 is like that of the safe 10, except as noted. It utilizes the mechanisms 41, 43, 45 as described above. The safe 210 can also be used in association with a retainer bracket 250 to prevent the contained gun from falling when the lid 214 is opened. The retainer 250 can be suitably secured to a wall, and is adapted to have the gun barrel releasably retained thereby by passing through an opening 251 that can have a barrel protective bead on the edge defining the opening 251. The safe 210 can also be mounted in a fixed position, for example, to a wall, as with screws. Preferably, the safe 210 is attached to a wall stud. In the illustrated embodiment, the base 215 has the upstanding side wall 223 with an open sided notch 260 on one side and an open sided notch 267 on the other side, respectively. Notch 260 is for receipt of a barrel portion of the gun to extend from, and notch 267 is for a butt stock portion of the gun to extend from. The lid 214 has the upstanding sidewall 219 with an open sided notch 268 on one side and an open sided notch 269 on the other side. The notch 268 is for receipt of a barrel portion of the gun therethrough, and the notch 269 is for a butt stock portion of the gun to extend from. When the safe is closed, the notches 260, 268 register with one another to form a through opening, and the notches 267, 269 register with one another to form a through opening. The edges of the notches 260, 267, 268 and 269 can have a protective bead 270 applied thereto to protect the stored firearm. Means is provided to limit longitudinal movement of the gun when secured in the safe 210. A support 272 is positioned inside the safe 210, and is mounted to and extends from the panel 221 of the base 215 into the storage chamber 211. The support 272 is sized, shaped and positioned to extend into the ejection port of the stored gun. The use of this support means that the gun bolt needs to be in its back position. A second support 273 is provided. The support 273 is positioned inside the safe 210 and is mounted to and extends from the panel 221 of the base 215 into the storage chamber 211. The support 273 is sized, shaped and positioned to be received in the open area between the back of the hand grip and the forward portion of the butt stock. The supports 272, 273 can be mounted in a positionally adjustable manner, and may have a protective member applied thereto to protect the firearm. If desired, the lid 214 can have a cutout 285 to accommodate a top mounted optic sight, such as a scope or red dot, mounted on the top of the stored firearm. The cutout can be in both the panel 217 and the sidewall 219, and can have a protective bead on the exposed edge. The base 215 could have a similar cutout.

A cover 280 is provided to shield the latch mechanism 45, power supply 101, motor 103, and drive 105 from contact with a contained firearm. The battery condition indicator 106 can be mounted on the cover 280. The cover 280 is mounted to the lid 214 in a removable manner, as with mechanical fasteners 281, to provide access to the batteries in the power supply 101 to effect replacement of the batteries. The cover 280 is also provided with through apertures 283, which are positioned to allow the catches 52 to move into selective engagement with their respective latch member 51 for locking of the lid 14 in its closed position.

Figure 10:
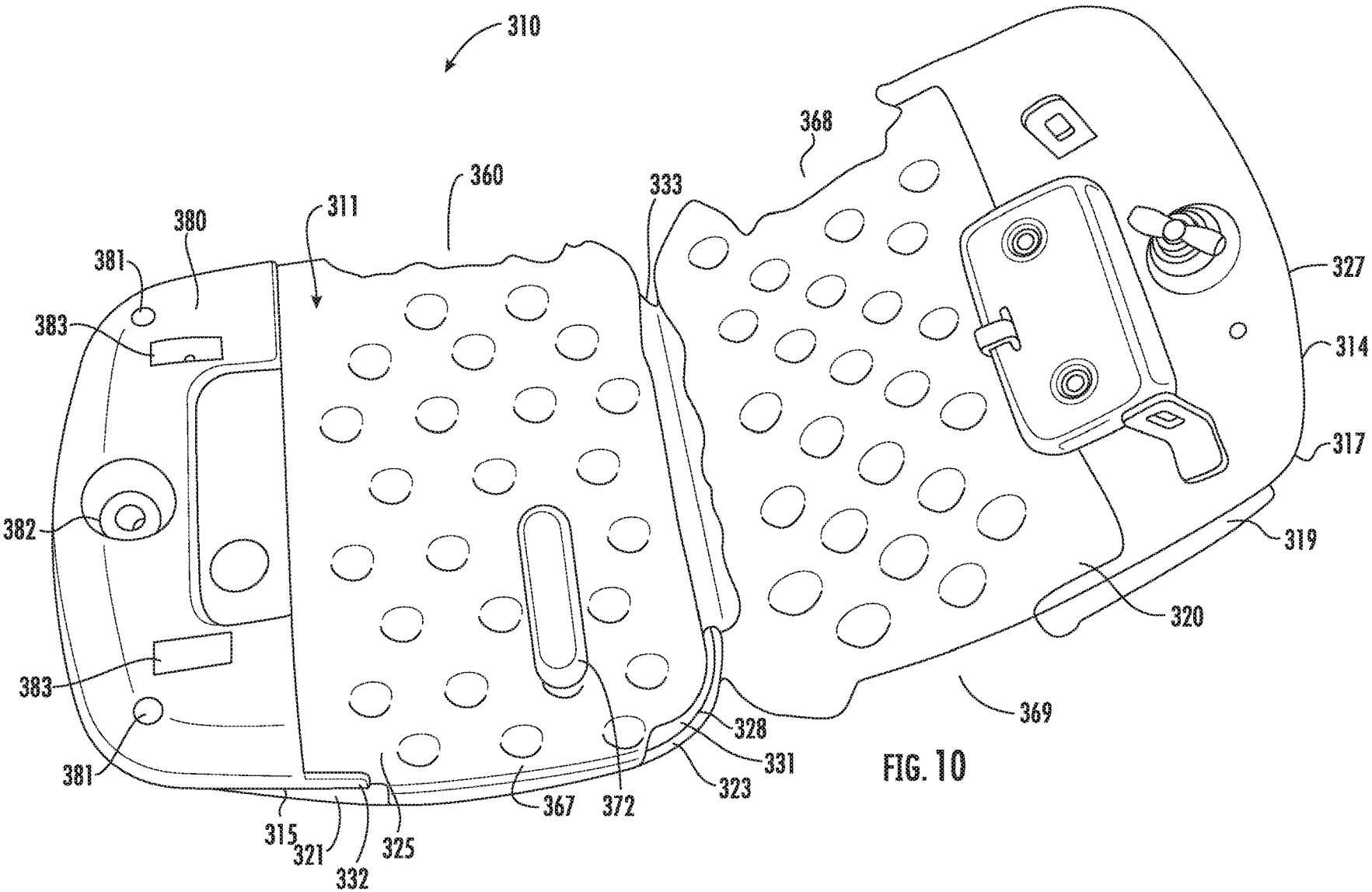
FIG. 10 is a perspective view of an alternate embodiment of a firearm storage safe for a shotgun.
Figure 11:
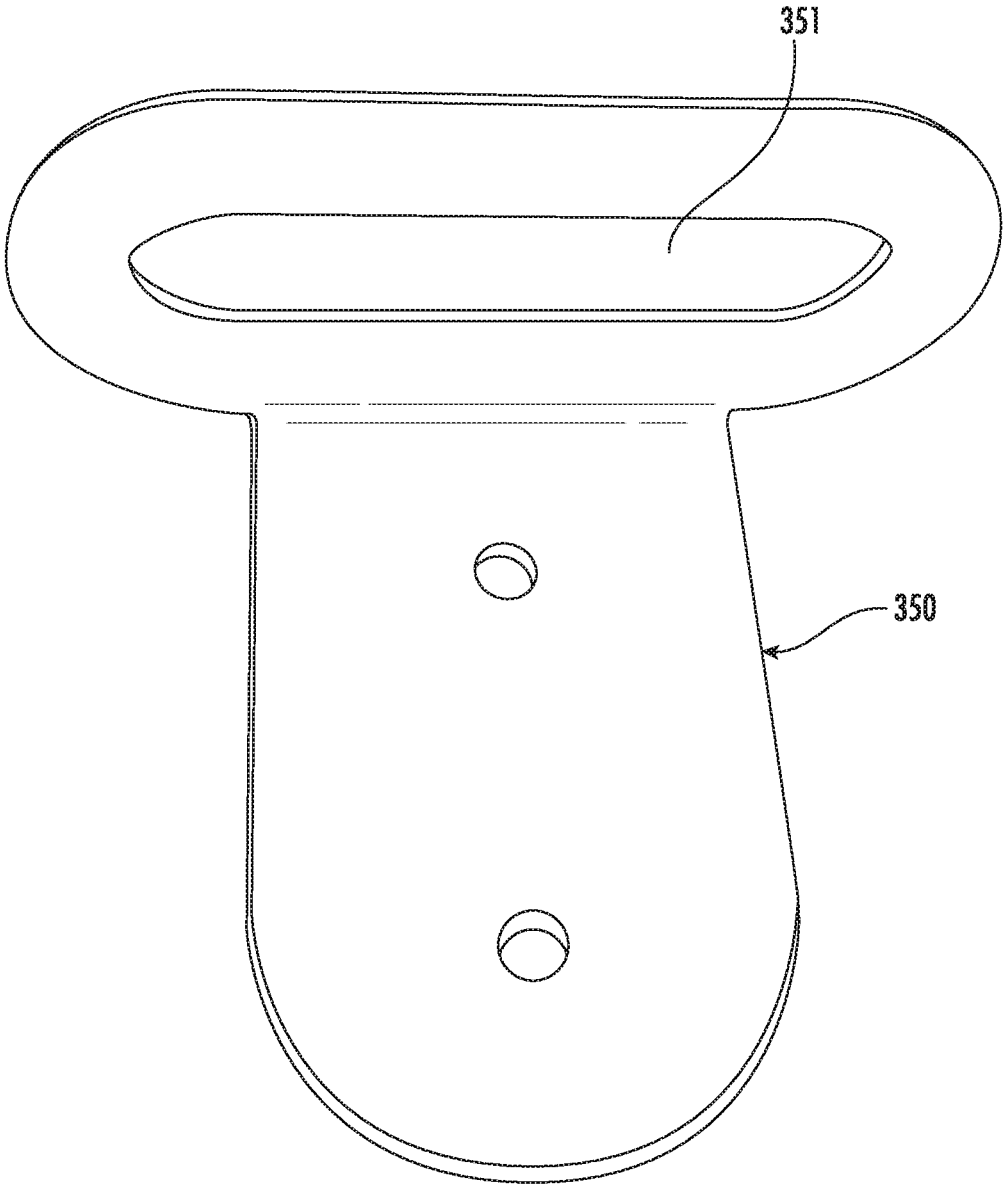
FIG. 11 is a perspective view of a barrel retaining bracket for use with the safe of FIG. 10.

FIGS. 10, 11 illustrate a third embodiment of a firearm storage safe. The third embodiment utilizes the same mechanisms 41, 43, 45 as disclosed above, but has a differently configured safe 310. The safe 310 is usable for storing a firearm, such as a single barrel shotgun (such as a pump or self loading shotgun), internally in a storage chamber 311. It differs from the safe 10 in size and shape, and allows portions of a contained gun to extend from opposite sides of the safe 310. Otherwise, and as described below, the construction of the safe 310 is like that of the safe 10, except as noted. The safe 310 includes both a lid portion 314 and a base portion 315. In the illustrated structure, the lid 314 and base 315 are cup shaped. The lid 314 has a main panel 317 with an upstanding sidewall 319 extending around much of the perimeter of the panel 317, forming a chamber portion 320 with an open side. The base 315 is similar in construction to the lid 314, having a main panel 321 with an upstanding sidewall 323 extending around much of the perimeter of the panel 321, forming a chamber portion 325 with an open side. The size and shape of the sidewalls 319 and 323 are similar so that their exposed edges 327, 328 mate when the lid 314 is in the closed position. In the illustrated embodiment, the base 315 is provided with an upstanding flange 331 that is positioned internally of the sidewall 323, and is received inside of, or sleeved, into the sidewall 319 when the lid 314 is in a closed position. Preferably, the flange 331 is integral with the sidewall 323, but can be formed separately and secured to the sidewall, as by welding. The edge 328 forms a ledge 332 between the sidewall 323 and flange 331, and is preferably rounded or beveled on the outside to resist a prying tool from applying a force between edge 328 and edge 327. The lid 314 and base 315 are joined together at adjacent edges of their respective sidewalls 319, 323 as with a hinge 333 that permits permanent joining of the lid 314 and base 315 together, and allows relative movement therebetween. In a preferred embodiment, the lid 314 and base 315 are formed of a metallic material such as steel, and can have a protective coating such as paint or the like thereon. It utilizes the mechanisms 41, 43, 45 as described above. The safe 310 can also be used in association with a retainer bracket 350 to prevent the contained gun from falling when the lid 314 is opened. The retainer 350 can be suitably secured to a wall, and is adapted to have the gun barrel releasably retained thereby by passing through an opening 351 that can have a protective bead on the edge defining the opening 351. The safe 310 can also be mounted in a fixed position, for example to a wall, as with screws. Preferably, the safe 310 is attached to a wall stud. One side portion of side wall 323 has an open sided notch 360, and an opposite side portion of sidewall 323 has an open sided notch 367. Notch 360 is for receipt of a barrel portion of the gun to extend from, and notch 367 is for a butt stock portion of the gun to extend from. One side portion of sidewall 319 has an open sided notch 368, and an opposite portion of sidewall 319 has an open sided notch 369. The notch 368 is for receipt of a barrel portion of the gun therethrough, and the notch 369 is for a butt stock portion of the gun to extend from. When the safe is closed, the notches 360, 368 register with one another to form a through opening, and the notches 367, 369 register with one another to form a through opening. The edges of the notches 360, 367, 368 and 369 can have a protective bead applied thereto to protect the stored firearm. Means is provided to limit longitudinal movement of the gun when secured in the safe 310. A support 372 is positioned inside the safe 310 and is mounted to and extends from the panel 321 of the base 315 into a storage chamber 311. The support 372 is sized, shaped and positioned to extend into the ejection port of the stored gun, and may have a protective member applied thereto to protect the firearm. The use of this support means that the gun bolt needs to be in its back position. The support 372 can be mounted in a positionally adjustable manner.

A cover 380 is provided to shield the latch mechanism 45, power supply 101, motor 103, and drive 105 from contact with a contained firearm. The battery condition indicator 106 can be mounted on the cover 380. The cover 380 is mounted to the base 315 in a removable manner, as with mechanical fasteners 381, to provide access to the batteries in the power supply 101 to effect replacement of the batteries. The cover 380 is provided with a through port 382 to allow the finger 96 access to the lever 90 to effect mechanical unlocking as described above. The cover 380 is also provided with through apertures 383, which are positioned to allow the catches 52 to move into selective engagement with their respective latch 51 for locking of the lid 314 in its closed position.

FIGS. 12-15 illustrate another embodiment of the present invention. It utilizes basically the same latch mechanism 45 as described above and at least one of a manual lock mechanism 441 and an electronic lock actuator 43 as described above. In the illustrated embodiment, only an electronic lock actuator is used. The latch mechanism in this embodiment is designated generally 445, and is basically the same as latch mechanism 45 except as noted below. For clarity, the safe is designated generally 410, and is similar in construction to the safe 10 as described above except as noted. The safe 410 is a storage device having a pair of hingedly connected components which is shown as including a lid 414 and a base 415. The lid 414 and base 415 define an open sided storage chamber 416 that can be selectively closed when the lid 414 is moved to its closed position. In the illustrated structure, the lid 414 is generally planar and the base 415 is cup shaped. The lid 414 has a main panel 417 with an upstanding sidewall 419 extending around the perimeter of the panel 417. The base 415 is similar in construction to the lid 14, having a main panel 421 with an upstanding sidewall 423 extending around the perimeter of the panel 421, forming a chamber portion 425 with an open side. Cushions 439, 440 as described above for cushions 39, 40 can be provided. The chamber portion 425 forms a majority of the storage chamber 416. The size and shape of the sidewalls 419 and 423 are similar, however the sidewall 419 is sized to receive a portion of the sidewall 423 therein, i.e., a portion of the sidewall 423 is sleeved inside a portion of the sidewall 419 and overlap when the lid 414 is in its closed position. Their exposed edges 427, 428 bypass one another during closing movement of the lid 414. It is to be understood that the sidewall 419 could be sleeved inside the sidewall 423 as an alternate. The lid 414 and base 415 are joined together at adjacent edges of their respective sidewalls 419, 423, as with a hinge (not shown but similar to hinge 33 described above) that permits permanent joining of the lid and base together and allows relative movement therebetween. The hinge (not shown) can be provided with one or more springs (not shown but similar to hinge 34 seen in FIG. 3), such as one or more torsion springs, to effect selective unassisted opening movement of the lid 414. In a preferred embodiment, the lid 414 and base 415 are formed of a metallic material, such as steel, and can have a protective coating such as paint or the like thereon.

The safe 410 is provided with a locking mechanism that can include one or more components as seen in FIGS. 3-7 and described above. It can include a manual lock mechanism, designated generally 441, and/or an electronic lock actuator designated generally 443. The lock mechanism 441 is mounted to the base 415. The locking mechanism also includes a latch mechanism designated generally 445. The mechanisms 441, 443, 445 (which are similar in construction and operation to the mechanisms 41, 43, 45, respectively, except as noted and as described above) cooperate with one another to effect locking the lid 414 in a closed configuration, and unlocking the lid 414 to allow it to move to an open position and are described above.

Figure 12:
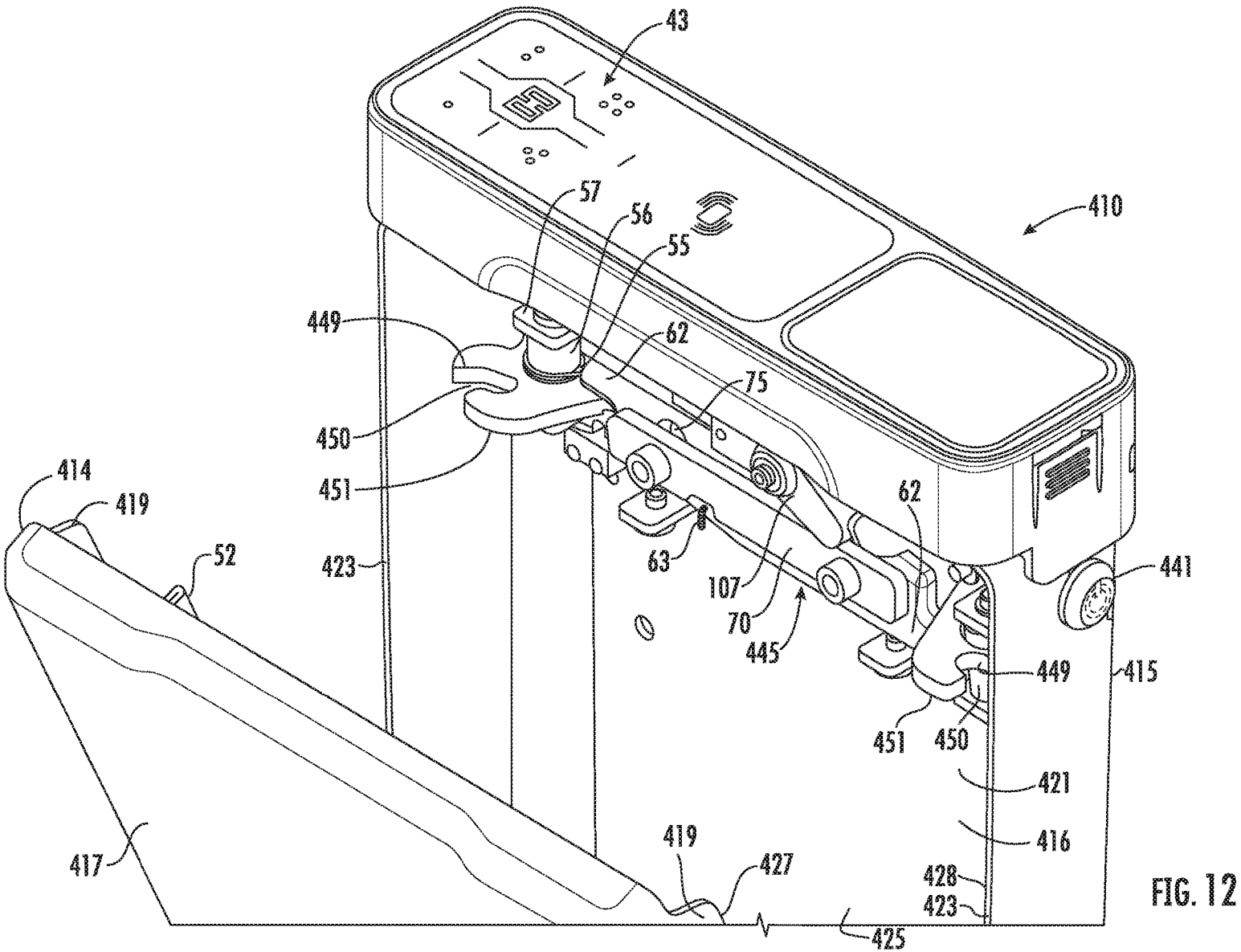
FIG. 12 is a fragmentary perspective view of a modified form of a latch mechanism shown with the latches in an unlatched orientation.

The latch mechanism 445 is seen in FIGS. 3-7 (denoted as 45 in these FIGS.), and FIGS. 12-15 and is secured to the base 415. While the latch mechanism 445 is show as being attached to the base 415 and the catch members 52 are shown and described as being attached to the lid 414, it is to be understood that this arrangement could be reversed. The latch members 451 are somewhat different in construction and orientation than the latch members 51 described above, but function similarly and have some similar features. The latch mechanism 445 is illustrated as having at least one latch member 451, and preferably a pair of spaced apart latch members 451, each positioned adjacent a respective side of the base 415. The latch members 451 are pivotally mounted hooks that have throats 450 opening outwardly (instead of inwardly as do the throats 50) from the pivot pin 60 mounting of the pawl 61. A latch member 451 has a first foot 449 extending outwardly (instead of inwardly as does a foot 49). The latch mechanism 445 also includes at least one catch member 52, and preferably a pair of catch members 52 (as described above). The catch members 52 are each positioned adjacent a respective side of the lid 414 and are positioned to engage and move a respective latch member 451. When the lid 414 is locked in the closed configuration, each latch member 451 is engaged with a respective catch member 52 by extending through a slot 53 in a respective catch member 52. The latch members 451 are each biased to a release position, pivoted inwardly, as with a respective torsion spring 55 mounted on a respective latch pivot pin 56. The movement of the latch members 451 for opening, i.e., inwardly, is in opposite directions of the movement for latching, i.e., outwardly. The release position is an inward pivoted position as seen in FIG. 12. The pivot pins 56 are mounted to a respective pair of spaced apart arms 57 integral with and extending from a base 58. The latch base 58 is secured to the panel 421 of the base 415 in any suitable manner, as by welding or mechanical fasteners 461.

Figure 13:
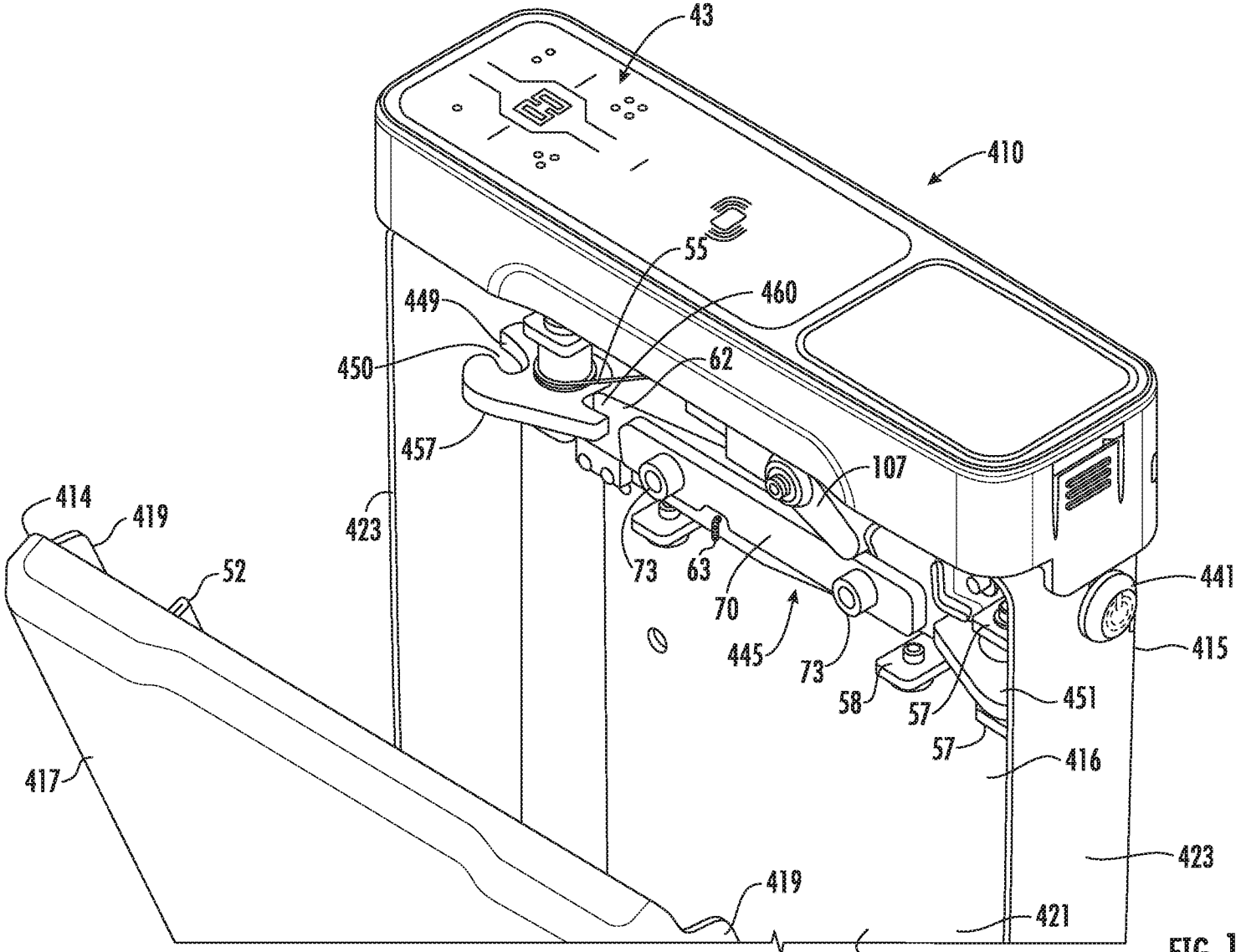
FIG. 13 is a fragmentary perspective view of the latch mechanism of FIG. 12, but with the latches shown in a latching orientation.
Figure 14:
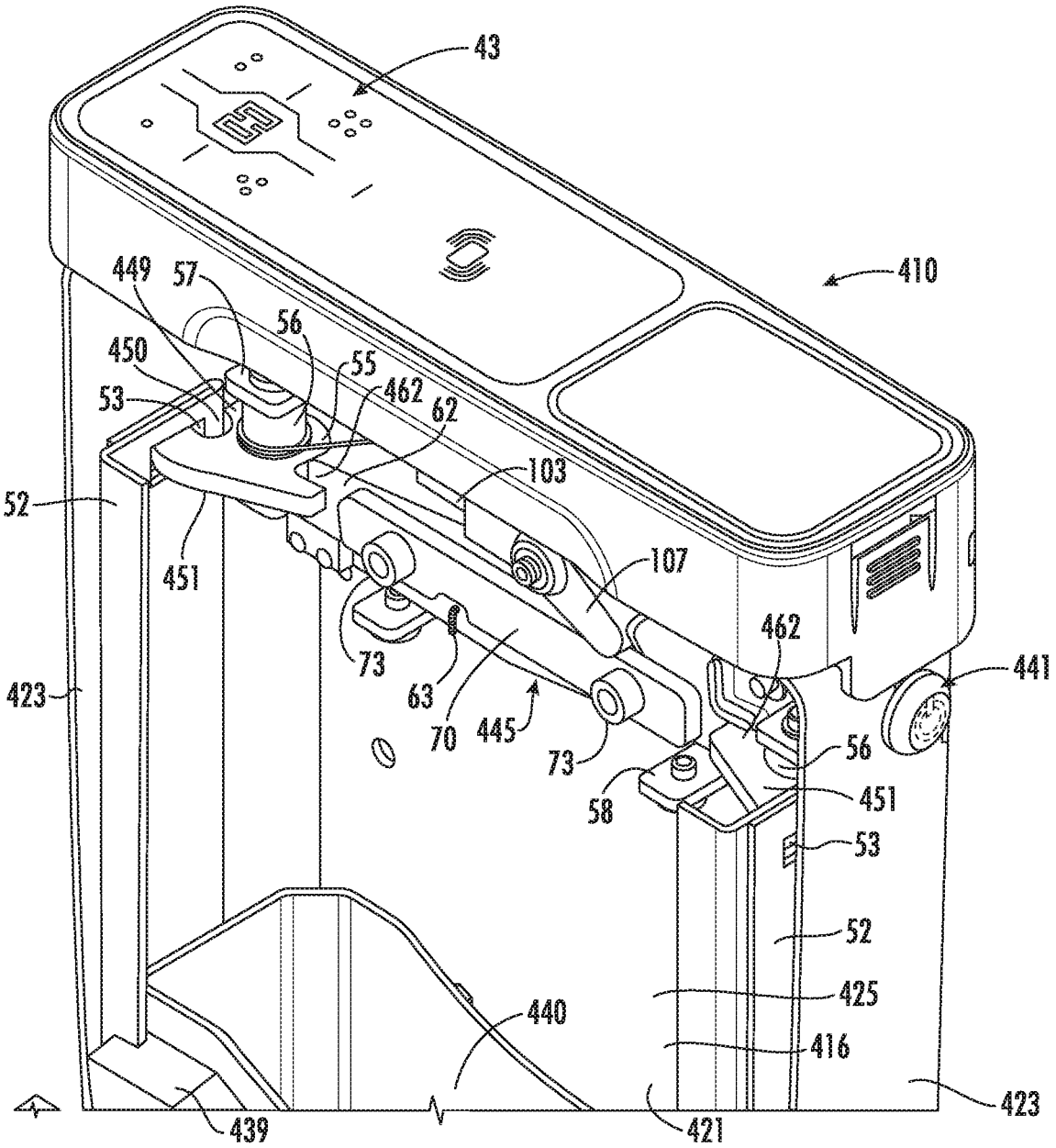
FIG. 14 is a fragmentary perspective view of the latch mechanism of FIGS. 12 and 13 with the latches shown in a latching orientation and associated with a respective catch with a portion of the pawl broken away to show details of the latch member.
Figure 15:
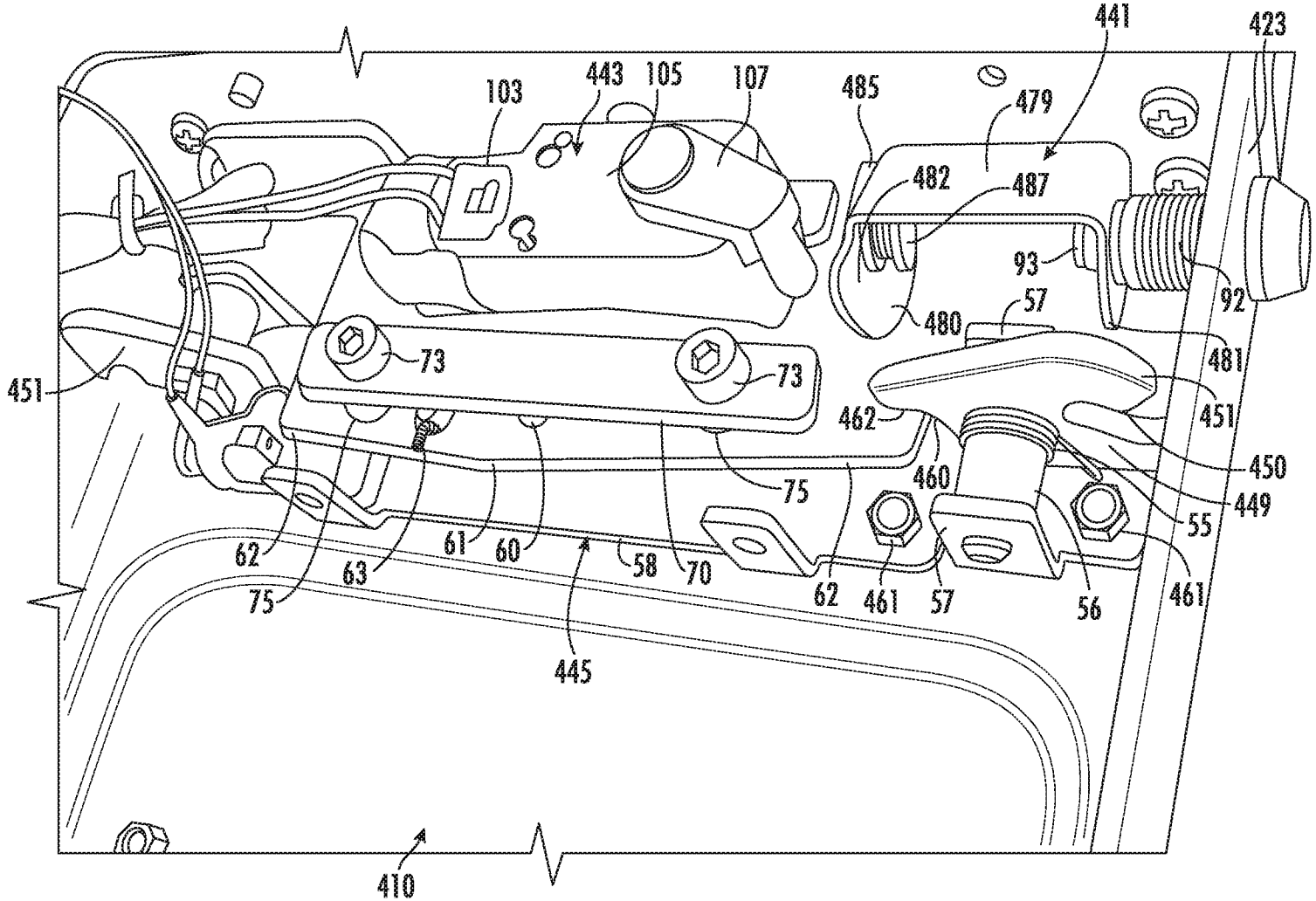
FIG. 15 is a fragmentary perspective view of the latch mechanism of FIGS. 12-14 showing the latch members in their latching position pivoted outwardly.

As seen in FIGS. 4, 5, 12-15, the pawl member 61 is in the form of a flat plate and is pivotally mounted to the latch base 58 with a pivot pin 60. The pawl 61 includes a pair of arm portions 62, each associated with a respective latch member 451 for releasably retaining the latch members 451 in a latching position, as seen in FIG. 14. As shown, the pawl 61 is balanced such that it pivots on the pivot pin 60 at its approximate center of mass. If the safe 410 is dropped, this centering and friction applied to the pawl will prevent a sufficient torque being applied from imbalance to force the pawl to pivot to a position that the latch members 451 are released and can move to an open position. A resilient biasing member, such as a torsion spring 63, is mounted on the pin 60 and resiliently biases the pawl 61 to its latching position as seen in FIGS. 13, 14, 15.

A hold down retainer 70 is mounted to the base 58 and overlies the pawl 61 to force it to pivot in a plane and not rock on the pivot pin 60 transverse to its pivot plane, and thus ensure it does not interfere with the pawl 61 moving to its latching position, as seen in FIG. 15. As shown, the retainer 70 is mounted on a pair of posts 72 (FIG. 7) secured to the base 58 and held in place by mechanical fasteners 73, such as threaded screws. The pawl 61 is provided with a pair of slots 75, each receiving a respective post 72 therethrough. The slots 75, in cooperation of the posts 72, limit pivoting movement of the pawl 61. The pawl 61 thus moves in a plane in a limited reciprocating manner. This plane of movement is generally parallel (within about +/−20°) to the panels 417, 421 when the lid 414 is closed, and generally normal to the plane of pivoting movement of the latch members 451; that is, close enough to normal that the latch members 451 will allow the arms 62 of the pawl 61 to move into and out of a respective notch 460 (FIG. 15) in each latch member 451 without functional interference. The notches 460 open inwardly and are sized and shaped to each selectively receive therein a respective arm portion 62 therein to releasably retain a respective latch member 451 in its catch retaining position, as seen in FIGS. 13, 14, and thus releasably retain the lid 414 in its closed position. Each notch 460 includes a second foot 462 that engages a back side of a respective arm portion 62 to retain the respective latch member 451 in its latched position, as seen in FIGS. 13, 14. To close and latch the lid 414, the catches 52 are moved with the lid 414 to engage a respective foot 449 and cause the latch member 451 to pivot and move the hook portion of the latch member 451 into a respective catch opening 53. This closing lid movement also moves each notch 460 into alignment with a respective arm portion 62, which pivots under the influence of spring 63 and moves into the respective notch 460 where the respective foot 462 engages the latch member 451 to selectively prevent its rotation out of latching engagement with a respective catch 52.

The operation of the at least one of a manual lock mechanism 441 and electronic lock actuator 443, except as noted, are as described above with regard to manual lock mechanism 41 and electronic lock actuator 43, respectively. The manual lock mechanism 441 is mounted to the base 415 and not the lid, as described above for the base 14. As shown, the mechanical lock 92 is secured to the sidewall 423 in a manner to prevent its rotation relative to the sidewall as described above. A bracket 479 is generally U-shaped having one leg 481 secured to the output shaft 93 and rotatable therewith. The distal end of the bracket 479 has a leg 482 with an eccentric 480 adjacent an edge of the pawl 61. The leg 482 is pivotally mounted to the base 415 via an upstanding leg 485, as with a pivot pin 487. Rotation of the lock cylinder with a key (not shown in FIGS. 12-15, but shown in FIG. 1 as key 98) and hence rotation of the output shaft 93 effects rotation of the bracket 479. This rotation in one direction moves the eccentric into the pawl 61, causing it to pivot against the torsion of the spring 63 to move the pawl out of engagement of the feet 462, allowing the latch members 451 to pivot to their unlatched positions. After manual unlocking, reverse rotation of the key 98 moves the eccentric 480 out of engagement with the pawl 61 and provides clearance for the pawl to move back to its latching position. Manual unlocking is independent of operation of the electronic lock actuator 443.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A storage device adapted to contain at least a portion of a firearm therein, said safe including:

a lid hingedly connected to a base, said lid and base cooperating to form an open sided storage chamber;

a locking mechanism associated with at least one of the lid and the base including an electronic lock actuator and a latch mechanism in cooperative association with one another to effect selective locking of the lid in a closed configuration and, upon unlocking, operable to allow the lid to move to an open position;

said latch mechanism including at least two catches mounted to one of the lid and the base and having a latching portion mounted to the other of the lid and the base, the latching portion including a pawl member formed from a flat plate pivotally mounted on a centrally positioned pivot with respect to the distal ends of the pawl member to define opposite end portions, said pawl member being pivotally movable on said pivot in a first plane between a first position releasably retaining the lid in a closed position, and a second position releasing said lid to move to an open position, said latch mechanism also including at least two latch members each pivotally mounted on a support for pivotal movement in a respective second plane generally perpendicular to said first plane, said latch members each being positioned to releasably engage one of said end portions of said pawl member and a respective catch member to selectively retain said lid in a closed position, said latch members each having at least one foot movable therewith, said pawl member end portions each being selectively engageable with a respective said foot member to retain said latch member in a position to engage a respective said catch to retain said lid releasably closed, and a said catch being shaped and positioned to engage a respective said foot during closing movement of the lid and operable to move the respective latch member from its catch release position to its catch retaining position to releasably retain the lid in a closed position;

a first resilient member operatively coupled with said pawl member biasing said pawl member to its first position;

a second resilient member operatively coupled with a respective said latch member biasing said latch member to its second position; and said electronic actuator selectively operably associated with the pawl member and operable to selectively pivot said pawl member to its second position.

2. The storage device of claim 1 wherein the locking mechanism including a manual locking mechanism operably associated with the pawl member and operable to selectively move said pawl member to its second position independent of operation of the electronic lock actuator.

3. The storage device of claim 1 wherein the pawl member is pivotally mounted to pivot about its approximate center of mass.

4. The storage device of claim 1 wherein a said latch member having a hook shaped portion with a throat opening generally inwardly toward the pivot and having a foot extending inwardly to selectively extend under a respective said pawl member end portion to selectively retain said lid in a closed position.

5. The storage device of claim 4 wherein there being a pair of said latch members, each having a hook shape with a throat opening generally inwardly toward the pivot and each said latch member having a foot extending inwardly to selectively extend under a respective said pawl member end portion to selectively retain said lid in a closed position.

6. The storage device of claim 5 wherein there being a pair of said catches, each said catch being shaped and positioned to engage a respective said foot during closing movement of the lid and thereby effect pivoting movement of a respective latch member to its latching position whereby the pawl member moves from its said second position to its said first position, said catches each having a through opening and said latch members each having a hook portion thereof extending through a respective said catch through opening when the lid is closed, whereby the pawl and the latches secure the lid in its said closed position.

7. The storage device of claim 1 wherein a said latch member having a hook shaped portion with a throat opening generally outwardly away from the pivot, said latch member having a first foot and a second foot, said first foot extending inwardly toward the pivot to selectively extend under a respective said pawl member end portion to selectively retain said lid in a closed position, said second foot extending generally outwardly away from the pivot.

8. The storage device of claim 7 wherein there being a pair of said latch members, each having a hook shape with a throat opening generally outwardly away from the pivot and each said latch member having a said first foot extending inwardly to selectively extend under a respective said pawl member end portion to selectively retain said lid in a closed position, each said latch member having a said second foot extending generally outwardly away from the pivot.

9. The storage device of claim 8 wherein there being a pair of said catches, each said catch being shaped and positioned to engage a respective said second foot during closing movement of the lid and thereby effect pivoting movement of a respective latch member to its latching position, whereby the pawl member moves from its said second position to its said first position, said catches each having a through opening and said latch members each having a hook portion thereof extending through a respective said catch through opening when the lid is closed, whereby the pawl and the latches secure the lid in its said closed position.

10. The storage device of claim 1 wherein the electronic lock actuator includes a biometric sensor for identifying an approved user to effect unlocking.

11. The storage device of claim 1 wherein the electronic lock actuator includes a radio frequency interrogator for identifying an approved user to effect unlocking.

12. A storage device for containing a firearm or other valuable comprising:

a housing having a first component and a second component hingedly connected to the first component, when the first and second components are in a closed configuration, the first and second components form a storage chamber with an open side, said second component including a second sidewall;

a locking mechanism associated with at least one of the first and second components and including at least one of a manual locking mechanism and an electronic lock actuator, and including a latch mechanism with a latching portion Mounted to one of the first and second components and being in cooperative association with said at least one of the manual locking mechanism and the electronic lock actuator and operable to effect selective locking of the first and second components in a closed configuration and, upon unlocking, operable to allow the one of the first and second components to move to an open position;

said latch mechanism latching portion including a pawl constructed from a metal plate pivotally mounted on a pivot centrally positioned with respect to the center of mass of the pawl, the pawl movable in a first plane from a latch position and an unlatched position by action of said at least one of the manual locking mechanism and the electronic lock mechanism, said latching portion also including at least one latch member mounted for pivotal movement in a second plane generally perpendicular to the first plane between a latching position and an unlatching position, said latch member having a hook with an open end throat; and said latch mechanism including at least one catch mounted to the other of the first and second components that the latching portion is not mounted to and selectively associated with a respective said at least one latch member such that, when said at least one latch member is in its latching position, a portion of the hook engages said catch effecting locking of the first and second components in a closed condition, and when said latch member moves to its unlatching position by action of said at least one of the manual locking mechanism and the electronic lock actuator, said at least one latch member effecting unlocking of the first component and the second component allowing movement of the first component relative to the second component to an open configuration, said catch being operable to engage a respective latch member to move it from its unlatching position to its latching position by closing movement of the first component relative to the second component.

13. The storage device as set forth in claim 12 wherein the first component being a lid and the second component being a base, said lid having a first portion of the storage chamber therein and the base having a second portion of the storage chamber therein.

14. The storage device as set forth in claim 13 including a first cushion in the first portion of the storage chamber and a second cushion in the second portion of the storage chamber.

15. The storage device of claim 12 wherein at least one of the first and second components having a main panel with an upstanding sidewall, said sidewall having portions on opposite sides of the main panel with a first sidewall portion on one of said opposite sides having a first through opening and a second sidewall portion on the other of the opposite sides having a second through opening, said first through opening being positioned to receive a barrel portion of a long gun therethrough and said second opening being positioned to receive a butt stock portion of a long gun therethrough.

16. The storage device of claim 12 wherein said hook throat opening generally outwardly when in the latching position.

17. The storage device of claim 12 wherein said hook throat opening generally inwardly when in the latching position.

18. The storage device of claim 12 wherein said latch member having a foot engaging a portion of the pawl when said pawl is in its latching position.

19. The storage device of claim 18 including a first resilient member operably associated with said latch member and resiliently biasing the latch member away from its latching position and including a second resilient member operably associated with said pawl and resiliently biasing the pawl toward its latching position.

20. The storage device of claim 12 wherein the electronic lock actuator includes a biometric sensor for identifying an approved user to effect unlocking.

* * * * *